US005812080A

United States Patent [19]

Takahashi

[11] Patent Number: 5,812,080

[45] Date of Patent: Sep. 22, 1998

[54] BROAD-BAND RADIO WAVE ABSORBER

[76] Inventor: Michiharu Takahashi, 390-190, Takatsu, Yachiyo-shi, Chiba-ken, Japan

[21] Appl. No.: 751,313

[22] Filed: Nov. 18, 1996

[30] Foreign Application Priority Data

Dec. 27, 1995 [JP] Japan ..... 7-354302

[51] Int. Cl.[6] ..... H01Q 17/00

[52] U.S. Cl. ..... 342/4

[58] Field of Search ..... 342/1–4

[56] References Cited

U.S. PATENT DOCUMENTS

| | | | |
|---|---|---|---|
| 2,464,006 | 3/1949 | Tiley | 342/4 |
| 3,307,186 | 2/1967 | Straub | 342/4 |
| 4,023,174 | 5/1977 | Wright | 342/4 |
| 4,970,634 | 11/1990 | Howell et al. | 342/1 |
| 5,208,599 | 5/1993 | Rudduck et al. | 342/4 |
| 5,214,432 | 5/1993 | Kasevich et al. | 342/3 |
| 5,276,448 | 1/1994 | Naito et al. | 342/4 |
| 5,394,150 | 2/1995 | Naito et al. | 342/4 |
| 5,543,796 | 8/1996 | Thomas et al. | 342/4 |
| 5,627,541 | 5/1997 | Haley et al. | 342/1 |

FOREIGN PATENT DOCUMENTS

| | | | |
|---|---|---|---|
| 1484602 | 6/1967 | France | 342/3 |
| 776158 | 6/1957 | United Kingdom | 342/4 |
| 814310 | 6/1959 | United Kingdom | 342/1 |

OTHER PUBLICATIONS

Dual–Purpose Acoustic and RF Anechoic Room: IBM Technical Disclosure Bulletin, vol. 19, No. 9, p. 3595, Feb. 1977.

Plastics as Microwave Dielectrics; William R. Cuming; produced by Emerson and Cuming, Inc, Canton, MA, Sep. 1958.

*Primary Examiner*—Charles T. Jordan
*Assistant Examiner*—Christopher K. Montgomery
*Attorney, Agent, or Firm*—Lorusso & Loud

[57] ABSTRACT

A broad-band radio wave absorber including a radio wave reflecting surface, and a plurality of magnetic members provided on the reflecting surface and arranged in columns and rows, each of the magnetic members being composed of a first layer in the form of a square tile or a cross and a second layer superimposed on the first layer and having at least one cylindrical block having a diameter smaller than the width of the first layer. The first layers of adjacent two magnetic members are in contact with each other. When the second layer has a plurality of cylindrical blocks, they are coaxially superimposed in turn in a step wise manner.

9 Claims, 12 Drawing Sheets

BROAD-BAND RADIO WAVE ABSORBER

BACKGROUND OF THE INVENTION

This invention relates to a broad-band radio wave absorber useful for constructing anechoic chambers.

An anechoic chamber is now widely used for performing a variety of tests such as for undesirable radiation (noise) from electronics apparatuses, for electromagnetic obstruction, for electromagnetic compatibility and for antenna characteristics. Such an anechoic chamber is provided with wave absorbers on the inside walls and ceilings thereof.

U.S. Pat. No. 5,276,448 discloses a wave absorber of a lattice structure showing a return loss of 20 dB or more for a radio wave of 30–1,000 MHz. In recent years, an increasing attention has been paid to an importance of electromagnetic immunity of electronic instruments. Because the frequency of radio waves generated from recent electronic instruments widely ranges, there is an increasing demand for wave absorbers having a high frequency absorption spectrum. In this respect, the above lattice structure-type wave absorber is not satisfactory.

Japanese Unexamined Patent Publication 5-82995 discloses a wave absorber of a superimposed lattice structure. This absorber has lowest and highest frequencies of 30 MHz and 3,000 MHz, respectively, and is effective for a broad band of frequencies. The superimposed lattice structure-type wave absorber, however, has a problem because of difficulty in manufacture. In particular, it is very difficult to prepare the structure, in which the top ferrite has a thickness of less than 1 mm, by molding, due to poor flowability of the powder mass, non-uniformity in molding pressure and poor mold-releasability.

SUMMARY OF THE INVENTION

It is, therefore, an object of the present invention to provide a wave absorber which is effective for a very wide range of frequencies.

Another object of the present invention is to provide a wave absorber of the above-mentioned type which may be produced in an economically acceptable manner.

It is a further object of the present invention to provide a wave absorber whose height in the direction of the incident wave is relatively small.

In accomplishing the foregoing objects, there is provided in accordance with one aspect of the present invention a broad-band radio wave absorber comprising a radio wave reflecting surface, and a plurality of magnetic members provided on said reflecting surface and arranged in columns and rows in the directions of the X- and Y-axes, respectively, each of said magnetic members comprising (a) a first layer provided on said reflecting surface and including a first section extending in parallel with the Y-axis and having
- a length L along the Y-axis,
- a height H along the Z-axis normal to the X- and Y-axes and
- a width W along the X-axis and a second section extending in parallel with the X-axis and having
- a length along the X-axis equal to L,
- a height along the Z-axis equal to H and
- a width along the Y-axis equal to W, and (b) a second layer superimposed on said first layer and including at least one cylindrical block having a central axis oriented in parallel with the Z-axis with the proviso that when said second layer has a plurality of cylindrical blocks, said cylindrical blocks are coaxially superimposed in turn in a step wise manner, said at least one cylindrical block having the maximum diameter $D_1$, said first sections of respective magnetic members in each row being aligned and said second sections of respective magnetic members in each column being aligned, said first and second sections of each of said magnetic members perpendicularly intersecting and bisecting each other at a position coinciding with the corresponding central axis, the distance between the central axes of adjacent two magnetic members in each column and in each row is P, wherein L, $D_1$, W and P meet with the following conditions:

$L=P$ $D_1<P$ $W<P$.

In another aspect, the present invention provides a broad-band radio wave absorber comprising a radio wave reflecting surface, and a plurality of magnetic members provided on said reflecting surface and arranged in columns and rows in the directions of the X- and Y-axes, respectively, each of said magnetic members including a first section extending in parallel with the Y-axis and having

- a length L along the Y-axis,
- a height H along the Z-axis normal to the X- and Y-axes and
- a width W along the X-axis, and a second section extending in parallel with the X-axis and having
- a length along the X-axis equal to L,
- a height along the Z-axis equal to H and
- a width along the Y-axis equal to W, said first sections of respective magnetic members in each row being aligned and said second sections of respective magnetic members in each column being aligned, said first and second sections of each of said magnetic members perpendicularly intersecting and bisecting each other at a center of the corresponding magnetic member, the distance between the centers of adjacent two magnetic members in each column and in each row is P, wherein L, H, W and P meet with the following conditions:

$L=P$ $W<P$ $H \leqq W$.

Generally, the relative magnetic permeability $\mu_r$ and the relative dielectric constant $\epsilon_r$ of a magnetic substance may be represented by the following formulas each containing a complex:

$$\mu_r=\mu_{r1}-j\mu_{r2} \quad (1)$$

$$\epsilon_r=\epsilon_{r1}-j\epsilon_{r2} \quad (2)$$

In the following description, the terms "relative permeability" and "relative dielectric constant" are intended to refer to $\mu_{r1}$ and $\epsilon_{r1}$, respectively, at the frequency of 1 KHz except otherwise specifically noted.

A layer in which both ferrite and gap (air) are present may be regarded, as a whole, as being equivalent to a hypothetical layer which is uniformly filled with a medium having a relative permeability and a relative dielectric constant which differ from those of the ferrite. Such a relative dielectric constant and a relative permeability of the hypothetical layer are herein referred to as being apparent ones. The apparent relative dielectric constant and apparent relative permeability of a layer vary with a size of the gap, as will be appreciated from the following description taken in conjunction with FIGS. 11(*a*) and 11(*b*).

FIG. 11(*a*) schematically illustrates an arrangement of two continuously juxtaposed magnetic members each having a cylindrical shape having a radius r of 10.0 mm, whereas FIG. 11(*b*) illustrates an arrangement in which an aperture s of 14 mm is formed between adjacent two magnetic members each having a cylindrical shape having a radius r of 3.0 mm. Each of the magnetic member of FIGS. 11(*a*) and 11(*b*) is formed of a ferrite having a relative permeability of 2,500 and oriented in the direction perpendicular to the incident direction of a radio wave. The distance p between central axes of the two magnetic members is 20 mm in each of the arrangements of FIGS. 11(*a*) and 11(*b*). The frequency dispersion of the apparent relative permeability of the arrangements of FIGS. 11(*a*) and 11(*b*) are as shown by plots A (solid lines) and B (chain lines) in FIG. 12, respectively.

As will be appreciated from the results shown in FIG. 12, because of the aperture s, the maximum values of $\mu_{r1}$ and $\mu_{r2}$ of the arrangement of FIG. 11(*b*) are smaller than those of the arrangement of FIG. 11(*a*) and, further, the frequency providing the maximum $\mu_{r2}$ is much higher in the arrangement of FIG. 11(*b*) than that in the arrangement of FIG. 11(*a*). Namely, the frequency dispersion of the apparent relative permeability significantly varies by the presence of an aperture between magnetic members.

BRIEF DESCRIPTION OF THE DRAWINGS

Other objects, features and advantages of the present invention will become apparent from the detailed description of the preferred embodiments of the invention which follows, when considered in light of the accompanying drawings, in which:

FIG. 2(*b*) is a plan view of the magnetic member of FIG. 2(*a*);

FIG. 2(*c*) is an elevational view of the magnetic member of FIG. 2(*a*);

FIG. 4(*b*) is a plan view of the magnetic member of FIG. 4(*a*);

FIG. 4(*c*) is an elevational view of the magnetic member of FIG. 4(*a*);

FIG. 5(*b*) is a plan view of the magnetic member of FIG. 5(*a*);

FIG. 5(*c*) is an elevational view of the magnetic member of FIG. 5(*a*);

FIG. 7(*b*) is an elevational view of the magnetic member of FIG. 7(*a*);

FIG. 11(*b*) is plan view of two juxtaposed magnetic members with a space being defined therebetween.

DETAILED DESCRIPTION OF THE PREFERRED EMBODIMENTS OF THE INVENTION

Figure 1:
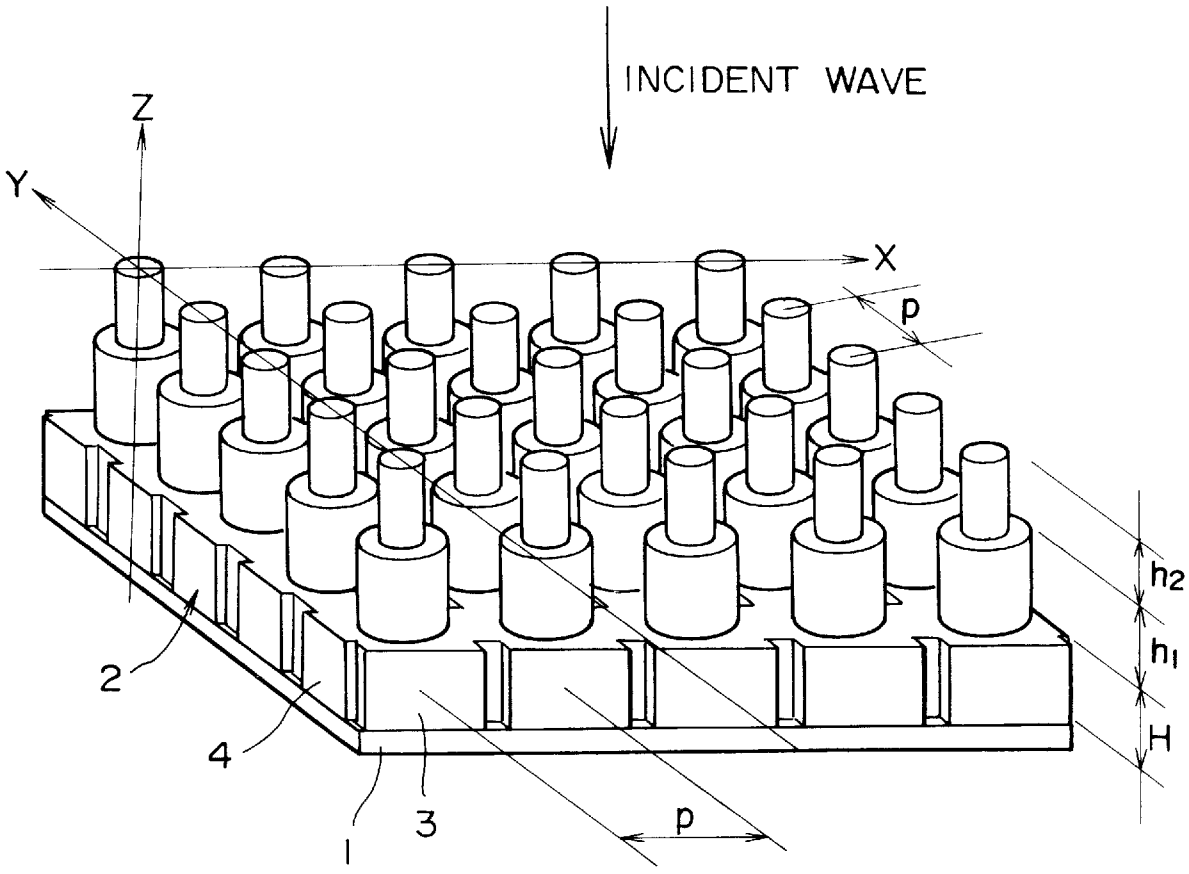
FIG. 1 is a perspective view showing one embodiment of a radio wave absorber according to the present invention.

Referring to FIG. 1, a broad-band radio wave absorber according to the present invention includes a radio wave reflecting surface 1, generally a conductive metal plate, and a plurality of magnetic members 2 fixedly attached to the reflecting surface 1 and arranged in columns and rows in the directions of the X- and Y-axes, respectively. Each of the magnetic members 2 is preferably uniformly formed of a ferrite-containing material such as sintered ferrite of NiZn-series or "rubber ferrite" containing ferrite powder dispersed in a matrix of a chloroprene rubber or a polyolefin or the like plastic material.

Figure 2B:
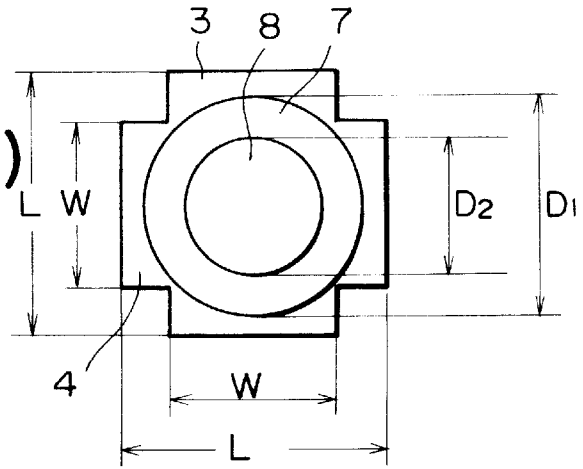
FIG. 2(*a*) is a perspective view showing a magnetic member of the embodiment of FIG. 1.
Figure 2C:
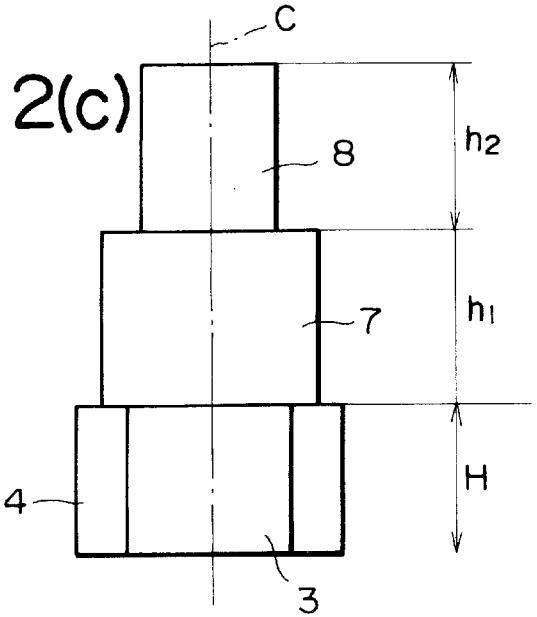
Figure 2A:
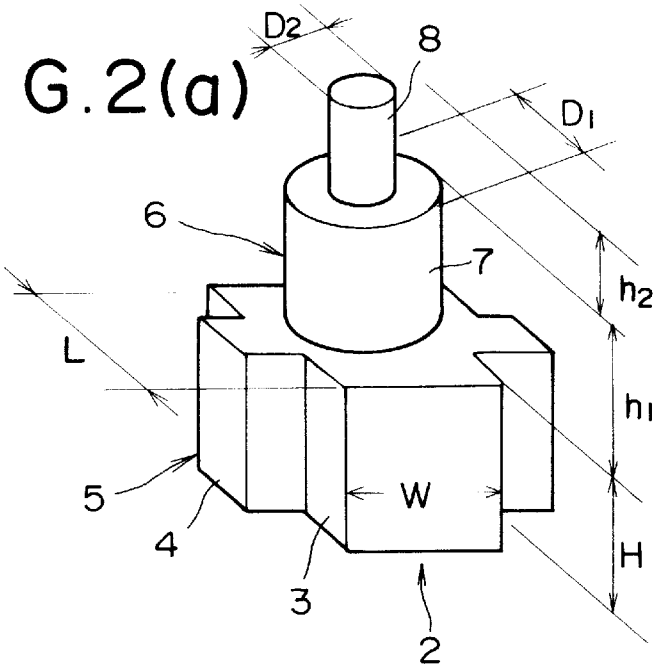

As shown in FIGS. 2(*a*)–2(*c*), each of the magnetic members 2 has a first layer 5 composed of a first section 3 extending in parallel with the Y-axis and a second section 4 extending in parallel with the X-axis. As seen from FIG. 1, the first sections 3 of respective magnetic members 2 in each row are aligned and the second sections 4 of respective magnetic members 2 in each column are aligned.

The first section 3 of each of the magnetic members 2 has a length L along the Y-axis, a height H along the Z-axis normal to the X- and Y-axes and a width W along the X-axis. Similarly, the second section 4 has a length along the X-axis equal to L, a height along the Z-axis equal to H and a width along the Y-axis equal to W. Thus, the height, length and width of the first and second sections 3 and 4 are the same with each other. The first and second sections 3 and 4 of each of said magnetic members perpendicularly intersect and bisect each other at the center thereof.

Each of the magnetic members 2 also has a second layer 6 superimposed on the first layer 5 and including at least one cylindrical block (two cylindrical blocks 7 and 8 in the illustrated embodiment) having a central axis C oriented in parallel with the Z-axis. As best seen in FIG. 2(*c*), when the second layer 6 has a plurality of cylindrical blocks 7 and 8, the blocks are coaxially aligned and superimposed in turn in a step wise manner. The lowermost cylindrical block 7 has a diameter $D_1$ which is greater than the diameters of other cylindrical blocks disposed on the block 7.

In the present invention, L, $D_1$, W and P meet with the following conditions:

$L=P$ $D_1<P$ $W<P$ wherein P represents a distance between the central axes C of adjacent two magnetic members 2 in each column and in each row (see FIG. 1).

Figure 3:
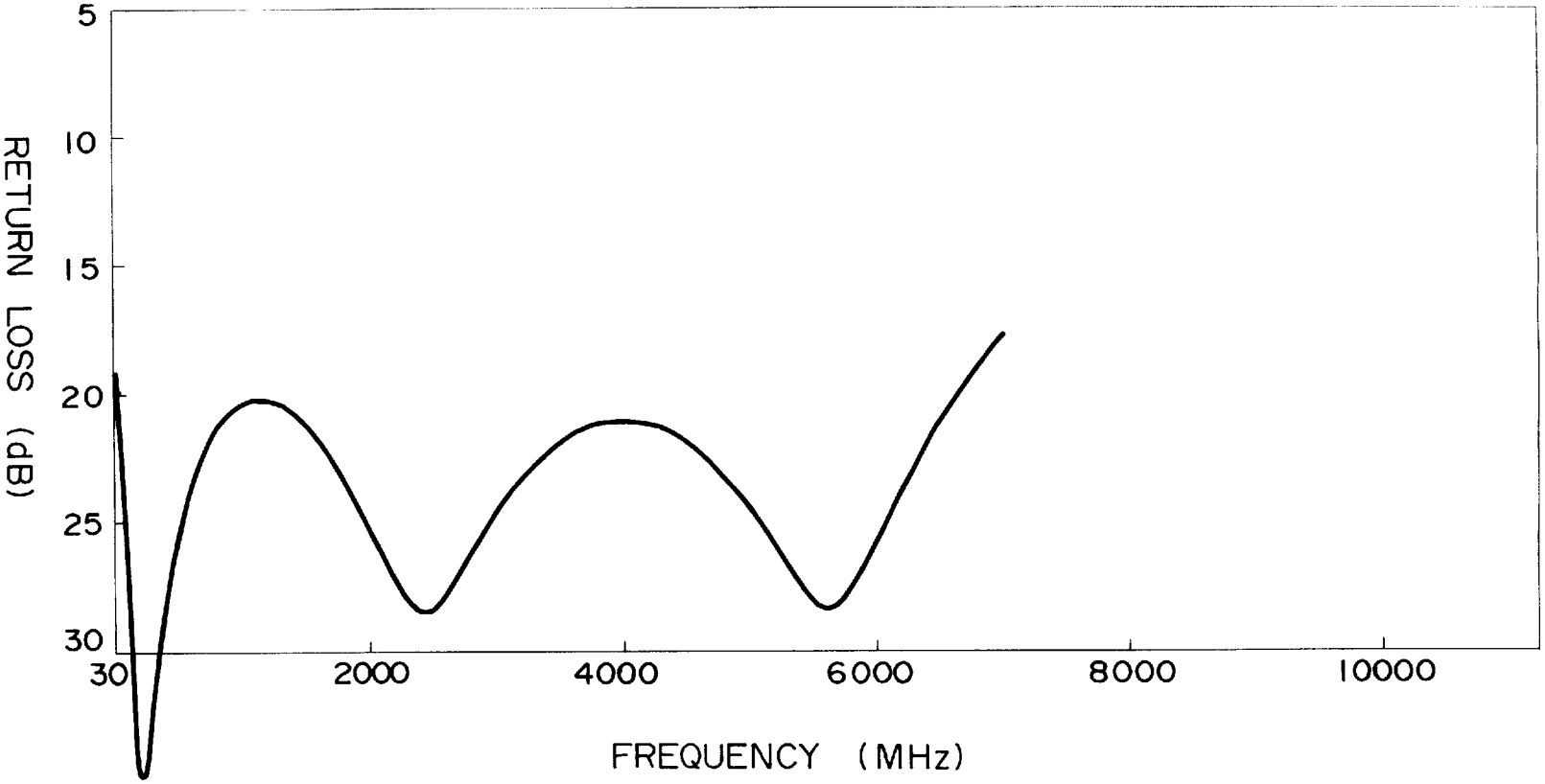
FIG. 3 is a graph showing radio wave absorbing characteristics of the radio wave absorber of FIG. 1.

When each of the magnetic members 2 shown in FIG. 1 is constructed as summarized below, the absorption characteristics of the wave absorber is as shown in FIG. 3. It will be appreciated that the wave absorber shows a return loss of 20 dB or more for a radio wave frequency in the range of 30–6,200 MHz.

Material of magnetic member 2: NiZn sintered ferrite
Relative permeability of ferrite: 2,500
Relative dielectric constant: about 15
Distance P between magnetic members 2: 20 mm
First layer 5:
First and second portions 3 and 4:
Length L: 20 mm
Width W: 15 mm
Height H: 8 mm
Apparent relative permeability: about 1,880
Apparent relative dielectric constant: about 12
Second layer 6:
First step 7:
Height $h_1$: 10 mm
Diameter $D_1$: 17.4 mm
Apparent relative permeability: about 4.1
Apparent relative dielectric constant: about 3.2
Second step 8:
Height $h_2$: 11 mm
Diameter $D_2$: 12 mm
Apparent relative permeability: about 1.6
Apparent relative dielectric constant: about 1.6

Figure 4B:
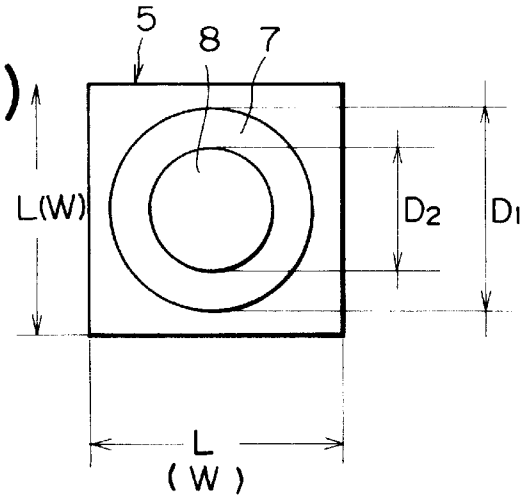
FIG. 4(*a*) is a perspective view showing a magnetic member of another embodiment of the present invention.
Figure 4C:
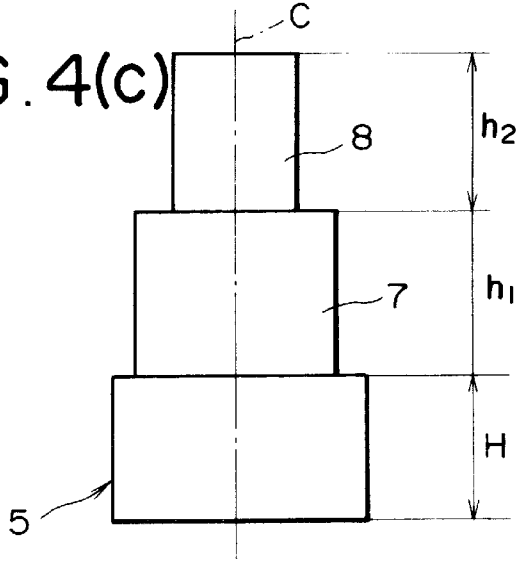
Figure 4A:
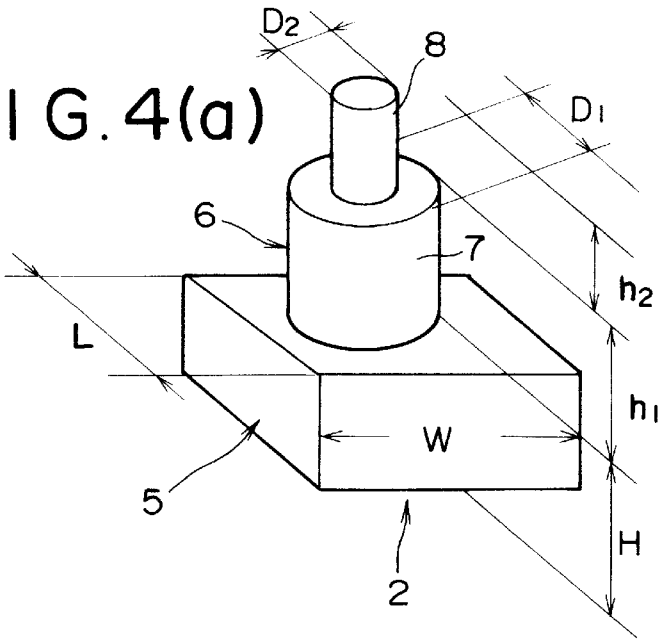

FIGS. 4(*a*)–4(*c*) depict an embodiment similar to that of FIG. 1 except that the width W of each of the magnetic element in this embodiment is equal to the length L so that the first layer is in the form of square tile.

When the wave absorber shown in FIGS. 4(*a*)–4(*c*) is constructed as summarized below, the wave absorber shows a return loss of 20 dB or more for a radio wave frequency in the range of 30–6,600 MHz.

Material of magnetic member: NiZn sintered ferrite
Relative permeability of ferrite: 2,500
Relative dielectric constant: about 15
Distance P between magnetic members 2: 20 mm
First layer 5:
Tile (First and second portions 3 and 4):
Length L: 20 mm
Width W: 20 mm
Height H: 6 mm
Apparent relative permeability: about 2,500
Apparent relative dielectric constant: about 15
Second layer 6:
First step 7:
Height $h_1$: 9 mm
Diameter $D_1$: 17.2 mm
Apparent relative permeability: about 3.8
Apparent relative dielectric constant: about 3.0
Second step 8:
Height $h_2$: 11 mm
Diameter $D_2$: 12 mm
Apparent relative permeability: about 1.6
Apparent relative dielectric constant: about 1.6

Figure 5B:
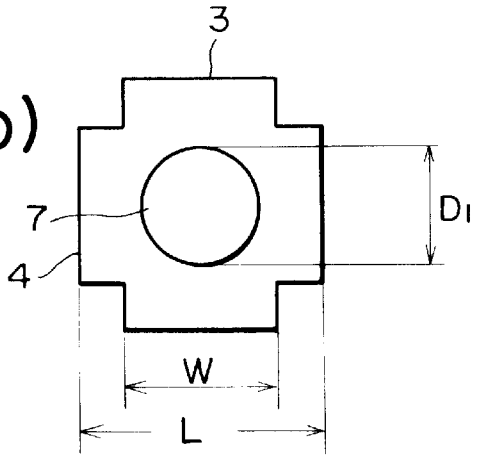
FIG. 5(*a*) is a perspective view showing a magnetic member of a further embodiment of the present invention.
Figure 5C:
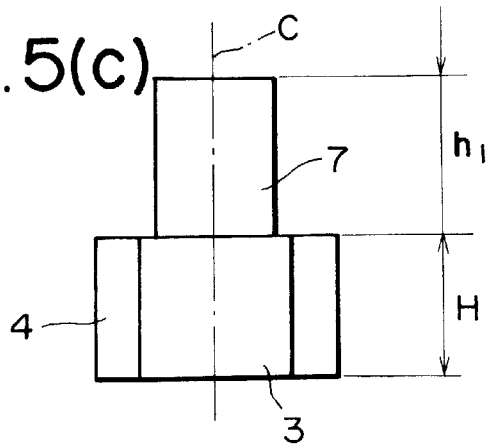
Figure 5A:
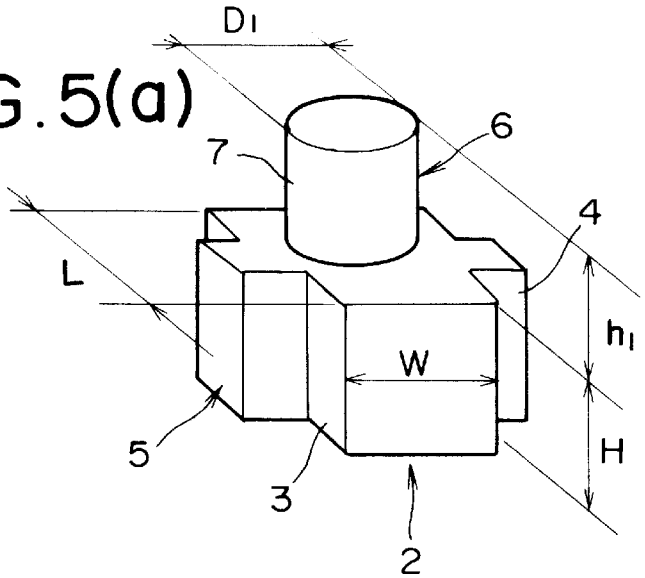

FIGS. 5(*a*)–5(*c*) illustrate an embodiment similar to that of FIG. 1 except that the second layer 5 of each of the magnetic members 2 is formed from a single cylindrical block 7.

Figure 6:
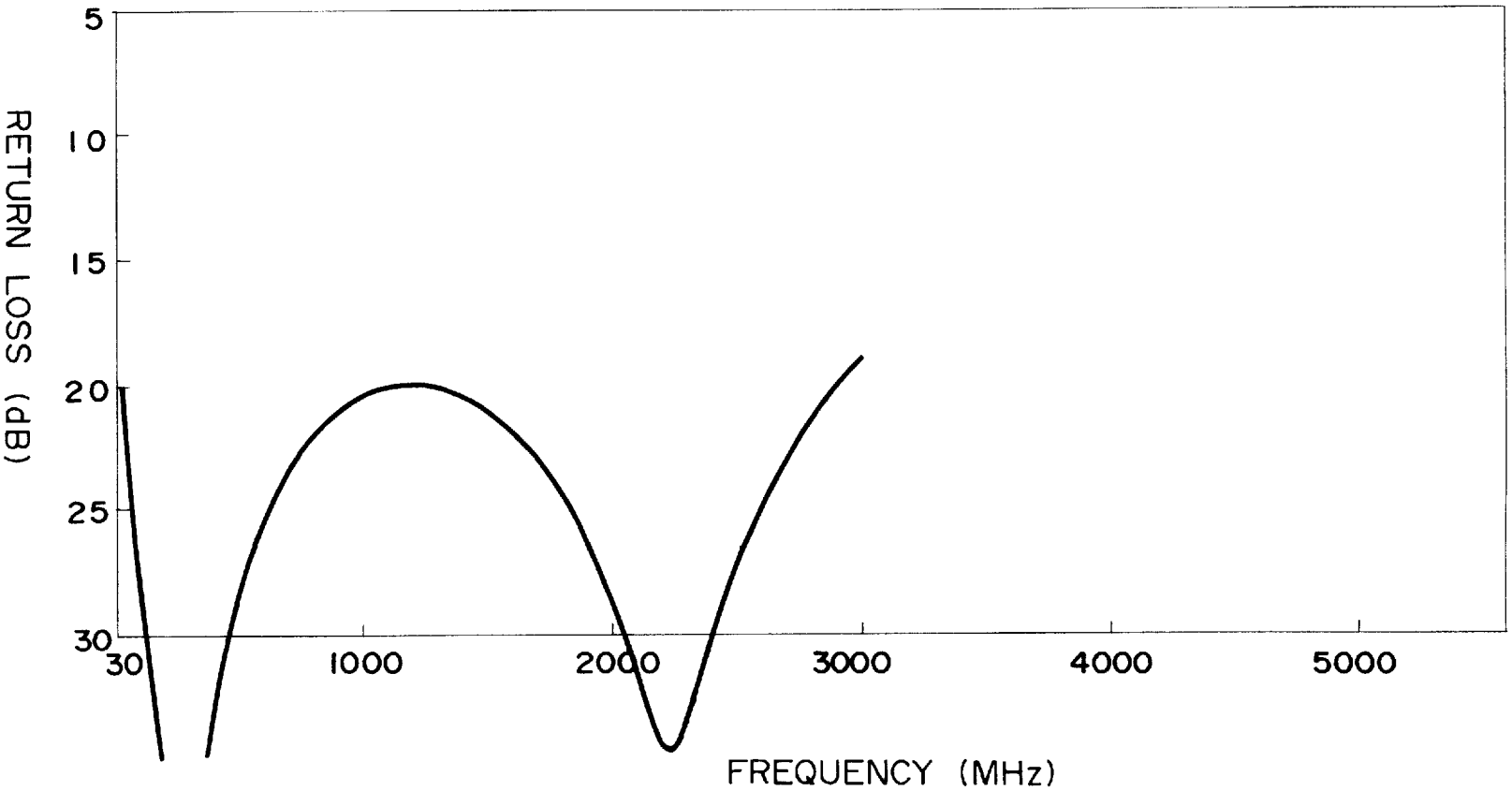
FIG. 6 is a graph showing radio wave absorbing characteristics of the radio wave absorber of FIG. 5(*a*)

When the magnetic member 2 is constructed as summarized below, the absorption characteristics of the wave absorber is as shown in FIG. 6. It will be appreciated that the wave absorber shows a return loss of 20 dB or more for a radio wave frequency in the range of 30–2,900 MHz.

Material of magnetic member 2: NiZn sintered ferrite
Relative permeability of ferrite: 2,500
Relative dielectric constant: about 15
Distance P between magnetic members 2: 20 mm
First layer 5:
First and second portions 3 and 4:
Length L: 20 mm
Width W: 15 mm
Height H: 8 mm
Apparent relative permeability: about 1,880
Apparent relative dielectric constant: about 12
Second layer 6:
First step 7:
Height $h_1$: 12 mm
Diameter $D_1$: 17 mm
Apparent relative permeability: about 3.6
Apparent relative dielectric constant: about 2.9

Figure 7A:
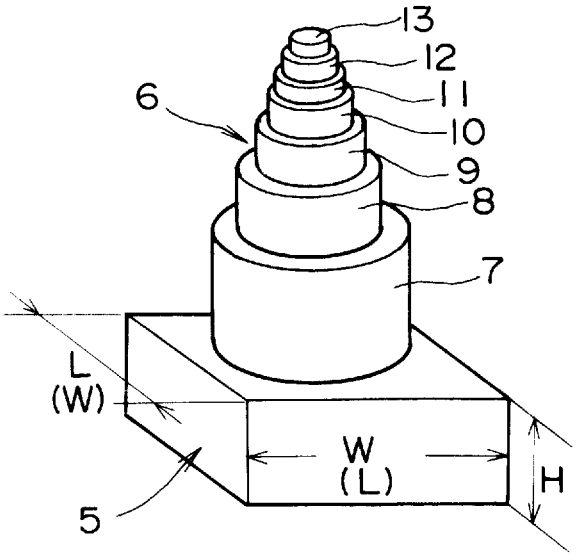
FIG. 7(*a*) is a perspective view showing a magnetic member of a further embodiment of the present invention.
Figure 7B:
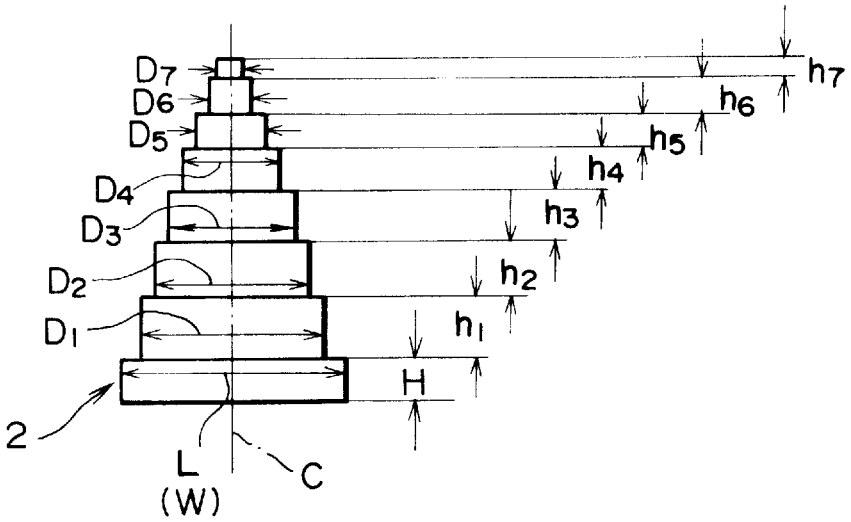

FIGS. 7(*a*) and 7(*b*) show an embodiment similar to that of FIGS. 4(*a*)–4(*c*) except that the second layer 6 of the magnetic member 2 has seven coaxially superimposed cylindrical blocks 7–13 on a flat tile-like first layer 5.

When the magnetic member 2 shown in FIGS. 7(*a*) and 7(*b*) is constructed as summarized below, the wave absorber shows a return loss of 20 dB or more for a radio wave frequency in the range of 30 MHz to 30 GHz.

Material of magnetic member: NiZn sintered ferrite
Relative permeability of ferrite: 2,500
Relative dielectric constant: about 15
First layer 5:
Tile (First and second portions 3 and 4):
Length L: 20 mm
Width W: 20 mm
Height H: 6 mm
Apparent relative permeability: about 2,500
Apparent relative dielectric constant: about 15
Second layer 6:
The height $h_1$–$h_7$, diameter $D_1$–$D_7$, apparent relative permeability $\mu_r$ and apparent relative dielectric constant $\epsilon_r$ of respective cylindrical blocks 7–13 are summarized in Table below.

TABLE

Dimension of Superimposed Cylindrical Blocks

| Cylindrical Block | Height (mm) | Diameter (mm) | $\mu_r$ | $\epsilon_r$ |
|---|---|---|---|---|
| 1 | $h_1 = 8$ | $D_1 = 18.2$ | 5.31 | 3.80 |
| 2 | $h_2 = 7$ | $D_2 = 16.0$ | 2.89 | 2.48 |
| 3 | $h_3 = 8$ | $D_3 = 14.0$ | 2.07 | 1.89 |
| 4 | $h_4 = 6$ | $D_4 = 12.0$ | 1.63 | 1.55 |
| 5 | $h_5 = 4$ | $D_5 = 10.0$ | 1.37 | 1.33 |
| 6 | $h_6 = 3$ | $D_6 = 8.0$ | 1.21 | 1.19 |
| 7 | $h_7 = 8$ | $D_7 = 6.0$ | 1.10 | 1.09 |

In each of the foregoing embodiments, the magnetic members 2 are made of sintered ferrite. In this case, the first layer has an apparent relative permeability of more than 1,000, while the apparent relative permeability of the second layer (composed of one or more layers of cylindrical blocks) is less than about 1/100 of that of the first layer. The wave absorbers having such a construction are operable for a wide range of frequencies.

The size of the magnetic member 2 in the foregoing embodiments may vary with the intended use of the broad-band radio wave absorber. Generally, the size of the magnetic member 2 is determined in consideration of the maximum and minimum frequencies of the incident radio wave. For example, when the incident radio wave has maximum and minimum frequencies of 20 GHz and 30 MHz, respectively, the preferred dimensions of the magnetic member 2 are as follows:

| | |
|---|---|
| Distance P: | $5 \leqq P \leqq 200$ mm |
| Length L of the first layer 5: | $5 \leqq L \leqq 200$ mm |
| Width W of the first layer 5: | $5 \leqq W \leqq 200$ mm |
| Height H of the first layer 5: | $3 \leqq H \leqq 20$ mm |
| Maximum Diameter $D_1$ of the second layer 6: | $5 \leqq D_1 \leqq 200$ mm |
| Total height h of the second layer 6: | $6 \leqq h \leqq 100$ mm |

Figure 8:
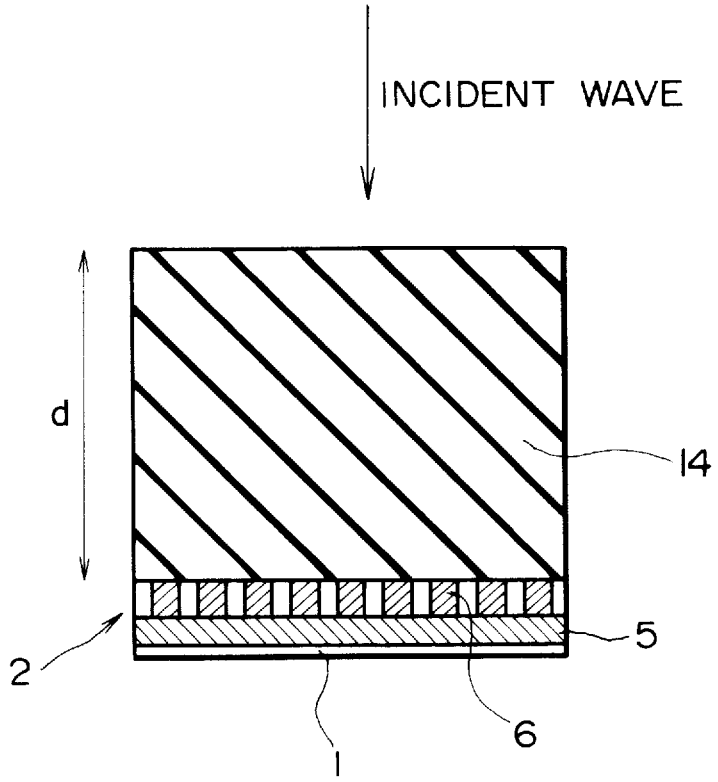
FIG. 8 is a cross-sectional elevational view showing a further embodiment of a radio wave absorber according to the present invention.
Figure 9:
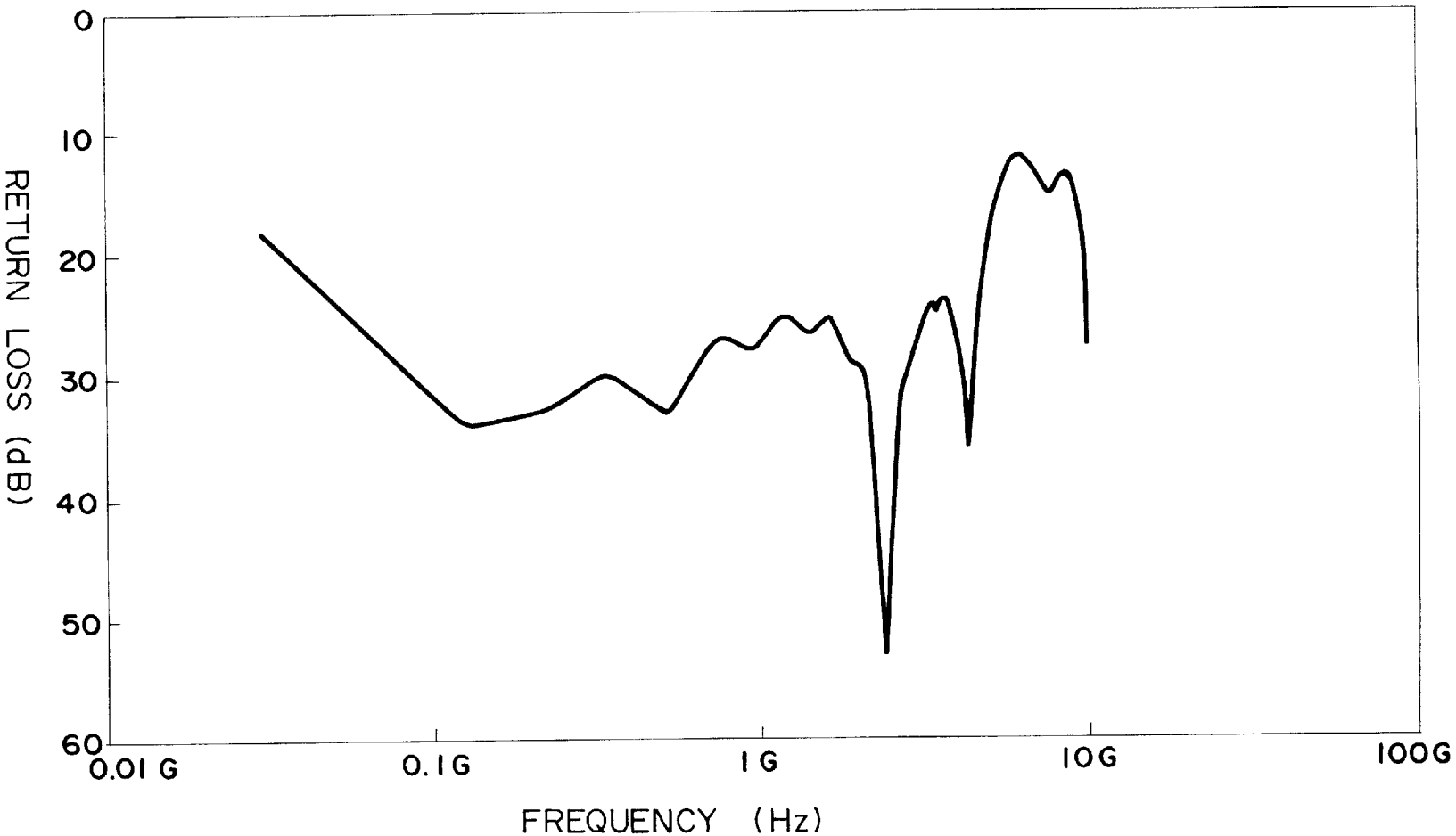
FIG. 9 is a graph showing radio wave absorbing characteristics of the radio wave absorber of FIG. 8.

FIG. 8 illustrates an embodiment similar to that of FIGS. 5(*a*)–5(*c*) having the absorption characteristics shown in FIG. 6 except that a layer 14 of a loss dielectric material is provided on the front of the second layers 6. When the layer 14 is formed of a foamed polyurethane which contains 0.5 g of homogeneously dispersed carbon powder per 1 liter volume of the polyurethane foam and which has a relative dielectric constant of about 1.2 and when the layer 14 has a thickness d of 300 mm and is provided to cover the entire top surface of the magnetic members 2, the resulting wave absorber shows absorbing characteristics as shown in FIG. 9. It will be noted that the provision of the loss dielectric layer 14 shows a return loss of 20 dB or more for a radio wave frequency in the range of 30 MHz to 5 GHz.

In the foregoing embodiments, the magnetic members 2 are formed of sintered ferrite. The magnetic member may be, however, formed of a so-called rubber ferrite in which ferrite powder is homogeneously dispersed in a matrix of a plastic material such as chloroprene rubber or polyolefin resin.

Figure 10:
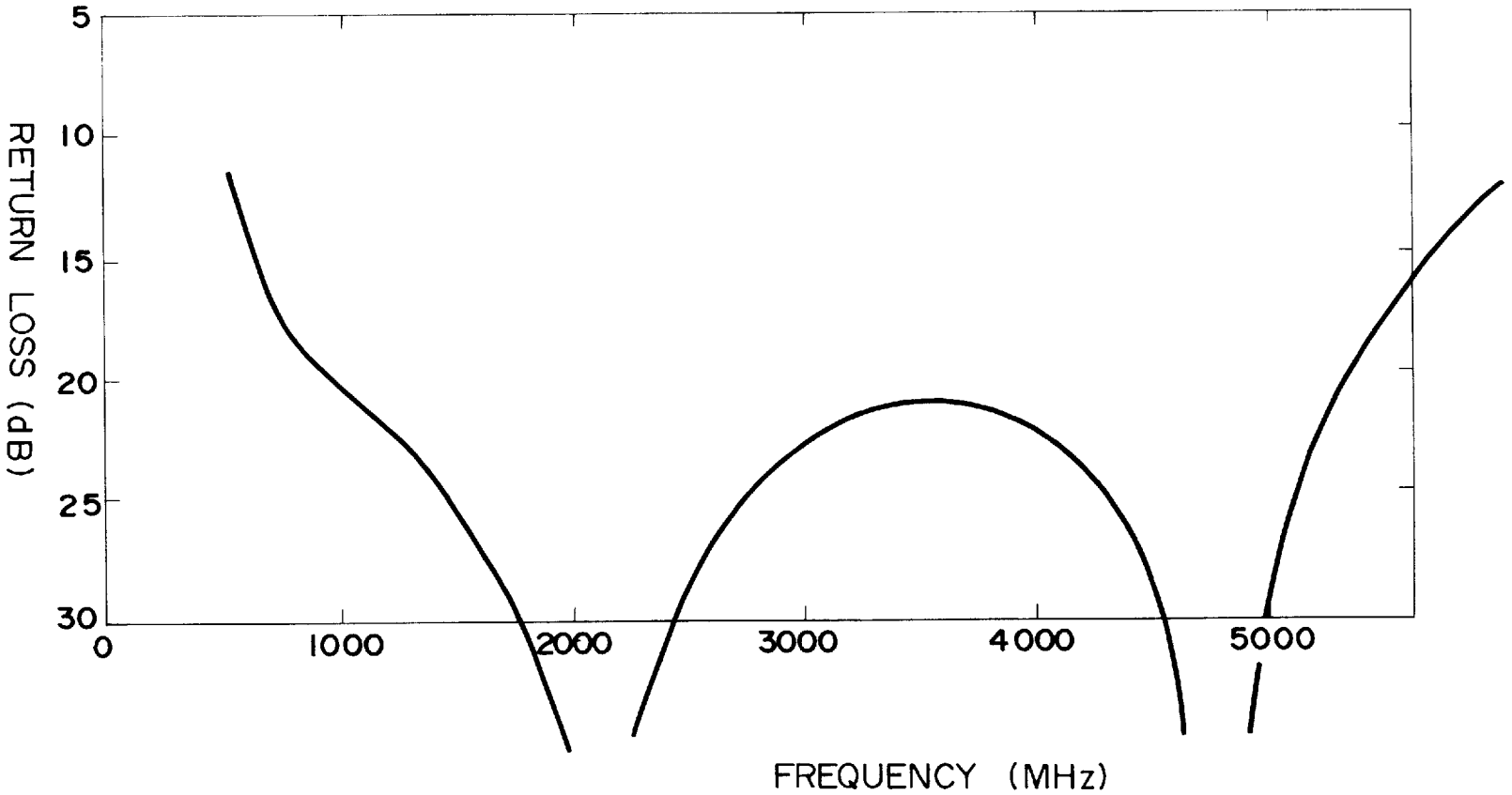
FIG. 10 is a graph showing radio wave absorbing characteristics of a radio wave absorber according to the present invention using a ferrite-containing rubber.
Figure 11A:
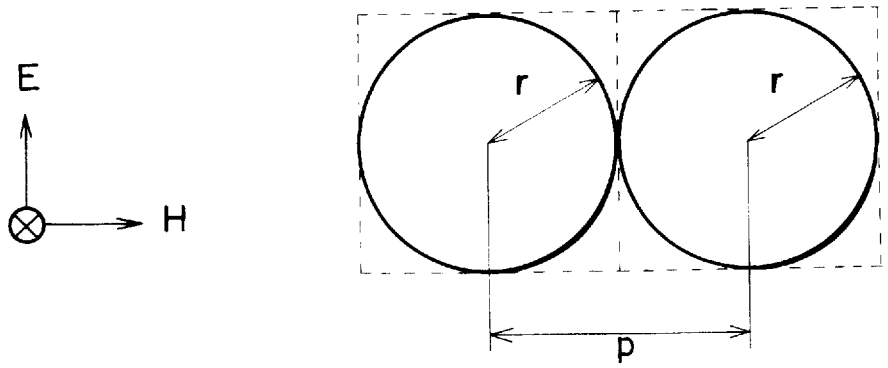
FIG. 11(*a*) is a plan view of two continuously juxtaposed magnetic members.
Figure 11B:
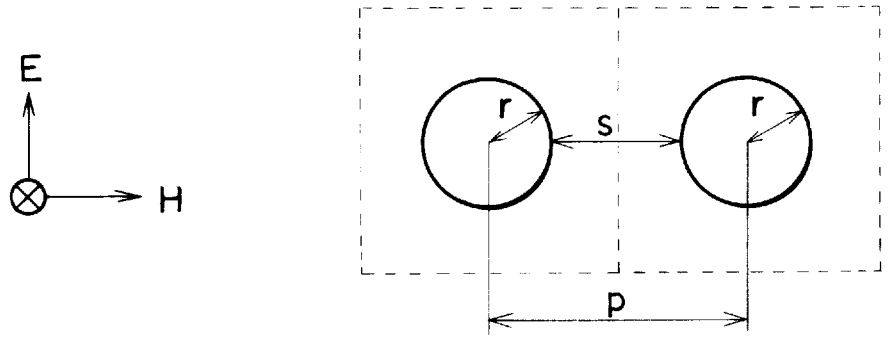
Figure 12:
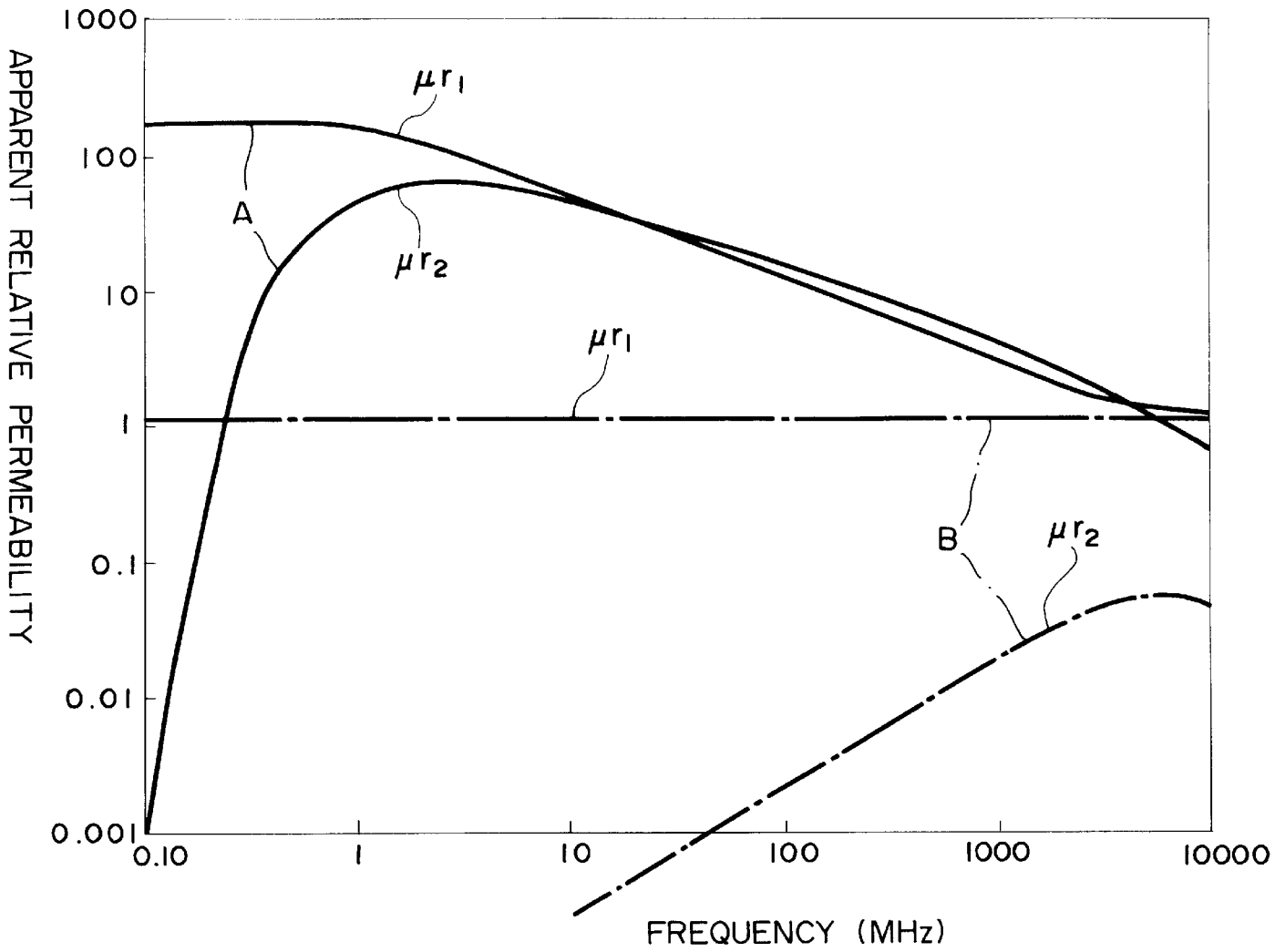
FIG. 12 is a graph showing frequency dispersion of the apparent relative permeability of the structures of FIGS. 11(*a*) and 11(*b*).

When the magnetic members 2 shown in FIGS. 5(*a*)–5(*c*) are constructed as summarized below using a rubber ferrite in which 10 parts by weight of sintered MnZn ferrite powder having a particle size of 5–50 $\mu$m are homogeneously dispersed in 1 part by weight of a matrix of chloroprene rubber, the absorption characteristics of the wave absorber is as shown in FIG. 10. It will be appreciated that the wave absorber shows a return loss of 20 dB or more for a radio wave frequency in the range of 1,000–5,300 MHz.

Material of magnetic member 2: Rubber ferrite
Relative permeability of rubber ferrite: about 10
Relative dielectric constant: 11
Distance P between magnetic members 2: 20 mm
First layer 5:
First and second portions 3 and 4:
Length L: 20 mm
Width W: 20 mm
Height H: 5 mm
Apparent relative permeability: about 10
Apparent relative dielectric constant: about 11
Second layer 6:
First step 7:
Height $h_1$: 15 mm
Diameter $D_1$: 15.2 mm
Apparent relative permeability: about 2.25
Apparent relative dielectric constant: about 2.1

When the second layer is formed of a plurality of superimposed cylindrical blocks, lower blocks (generally first and second steps) adjacent the first layer may be formed of sintered ferrite whereas the remainder upper blocks may be formed of a rubber ferrite which is lighter in weight than sintered ferrite.

In the foregoing embodiments, the cylindrical blocks of the second layer 6 of the magnetic member 2 are shown as having a circular cross-section. However, if desired, the cross-section may be polygonal. Further, when the first layer 5 is in the form of a cross, part of corners (such as four corners defined by first and second sections 3 and 4) of the cross may be rounded, if desired.

A wave absorber having a construction in which the second layer 6 has been removed from the embodiment shown in FIG. 1 and in which the first layer 5 meets with the following conditions shows an improved wave absorbing characteristics as compared with a conventional absorber composed of tile-like magnetic members:

$L=P$
$W<P$
$H \leqq W$.

For example, when the magnetic member 2 is constructed as summarized below, the wave absorber shows a return loss of 20 dB or more for a radio wave frequency in the range of 30–575 MHz in contrast with 30–450 MHz attained by the conventional structure.

Material of magnetic member 2: NiZn sintered ferrite
Relative permeability of ferrite: 2,500
Relative dielectric constant: about 15
Distance P between magnetic members 2: 20 mm
First layer 5:
First and second portions 3 and 4:
Length L: 20 mm
Width W: 15 mm
Height H: 8 mm
Apparent relative permeability: about 1,880
Apparent relative dielectric constant: about 12

In the present specification, the characteristics of wave absorbers are measured with a tri-plate transmission line using a TEM wave.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A broad-band radio wave absorber comprising a radio wave reflecting surface lying in a plane defined by X- and Y-axes, and a plurality of magnetic members provided on said reflecting surface and arranged in columns and rows in the directions of the X- and Y-axes, respectively, each of said magnetic members comprising (a) a first layer provided on said reflecting surface and including a first section extending in parallel with the Y-axis and having a length L along the Y-axis, a height H along a Z-axis normal to the X- and Y-axes and a width W along the X-axis and a second section extending in parallel with the X-axis and having a length along the X-axis equal to L, a height along the Z-axis equal to H and a width along the Y-axis equal to W, and (b) a second layer superimposed on said first layer and including at least one cylindrical block having a central axis oriented in parallel with the Z-axis, said at least one cylindrical block having a maximum diameter D, said first sections of respective magnetic members in each row being aligned and said second sections of respective magnetic members in each column being aligned, said first and second sections of each of said magnetic members perpendicularly intersecting and bisecting each other at a position aligned with said central axis, the distance between the central axes of adjacent two magnetic members in each column and in each row is P, wherein L, D, W and P meet with the following conditions:

$L=P$ $D<P$ $W<P$.

2. An absorber as claimed in claim 1, wherein said second layer of each of said magnetic members consists of one cylindrical block.

3. An absorber as claimed in claim 1, wherein said second layer of each of said magnetic members consists of one cylindrical block having a height along the Z-axis of h and wherein $W \leqq h$.

4. An absorber as claimed in claim 1, wherein each of said magnetic members is formed of a sintered ferrite.

5. An absorber as claimed in claim 1, wherein said the first layer has an apparent relative permeability of 1,000–3,000 and said second layer has an apparent relative permeability of 1.01–10.

6. An absorber as claimed in claim 1, wherein at least part of each of said magnetic members is formed of a blend of sintered ferrite with a synthetic polymeric material.

7. An absorber as claimed in claim 1, further comprising a layer of a loss dielectric material provided to cover top surfaces of said plurality of magnetic members.

8. An absorber as claimed in claim 1 wherein said second layer includes a plurality of cylindrical blocks coaxially superimposed in a step-wise manner.

9. A broad-band radio wave absorber comprising a radio wave reflecting surface lying in a plane defined by X- and Y-axes, and a plurality of magnetic members provided on said reflecting surface and arranged in columns and rows in the directions of the X- and Y-axes, respectively, each of said magnetic members comprising (a) a first layer in the form of a square plate provided on said reflecting surface and having a length L along the Y-axis, a height H along a Z-axis normal to the X- and Y-axes and a width W along the X-axis; and (b) a second layer superimposed on said first layer and including a plurality of cylindrical blocks coaxially superimposed in a step-wise manner, along a central axis oriented in parallel with the Z-axis, each of said first cylindrical blocks having a maximum diameter D, and wherein the distance between the central axes of adjacent two magnetic members in each column and in each row is P, wherein L, D, W and P meet with the following conditions:

$L=P=W$ $H \leqq P$.

* * * * *